United States Patent [19]

Fetters

[11] Patent Number: 4,992,412

[45] Date of Patent: Feb. 12, 1991

[54] AQUEOUS BASED DEVELOPER COMPOSITION

[75] Inventor: Robert A. Fetters, Chillicothe, Ohio

[73] Assignee: The Mead Corporation, Dayton, Ohio

[21] Appl. No.: 212,648

[22] Filed: Jun. 28, 1988

[51] Int. Cl.[5] ..... B41M 5/16; B41M 5/22

[52] U.S. Cl. ..... 503/225; 427/150; 427/152; 428/342

[58] Field of Search ..... 427/150–152; 428/341, 342, 913, 914; 503/225, 209, 214

[56] References Cited

U.S. PATENT DOCUMENTS

| | | | |
|---|---|---|---|
| 3,914,511 | 10/1975 | Vassiliades | 428/411 |
| 3,970,769 | 7/1976 | Kato et al. | 427/150 |
| 4,025,490 | 5/1977 | Weaver | 260/53 |
| 4,112,138 | 9/1978 | Davis et al. | 427/54 |
| 4,143,890 | 3/1979 | Davis et al. | 282/27.5 |
| 4,147,830 | 4/1979 | Kato et al. | 427/150 |
| 4,226,962 | 10/1980 | Stolfo | 525/506 |
| 4,262,936 | 4/1981 | Miyamoto | 282/27.5 |
| 4,263,344 | 4/1981 | Radvan et al. | 503/209 |
| 4,354,697 | 10/1982 | Fuchigami | 282/27.5 |
| 4,391,852 | 7/1983 | Nakamura et al. | 427/150 |
| 4,416,471 | 11/1983 | Yamato et al. | 282/27.5 |
| 4,422,670 | 12/1983 | Hasegawa et al. | 282/27.5 |
| 4,612,254 | 9/1986 | Ginter et al. | 428/531 |
| 4,620,874 | 11/1986 | Booth, Jr. et al. | 106/21 |

*Primary Examiner*—Bruce H. Hess

*Attorney, Agent, or Firm*—Thompson, Hine and Flory

[57] ABSTRACT

A process for preparing a developer sheet and a developer sheet are disclosed wherein an aqueous dispersion of a phenolic resin containing about 30 to 60% by weight of a phenolic resin is applied to the front surface of a substrate; the composition provides good image intensity and when applied at a controlled rate in full or spot coverage can be used on press with limited drying.

20 Claims, No Drawings

AQUEOUS BASED DEVELOPER COMPOSITION

BACKGROUND OF THE INVENTION

The present invention relates to an improved method for preparing a carbonless manifold form.

Carbonless paper is now widely used in the forms industry. A typical carbonless form is made up of one sheet, known as a CB sheet, which is the first page of the form and a second sheet, know as a CF sheet, which is the back page of the form. Where a form having more than two sheets is desired, as in the case where more than one copy is required, one or more sheets known as CFB sheets may be placed between the CF and the CB sheet. A CB sheet consists of a sheet of paper having a layer of microcapsules containing a color former coated on its back side, hence the designation CB or "coated back." A CF sheet consists of a sheet of paper carrying a layer of a developer material on its front side or "coated front" which reacts with the color former to produce a colored mark. A CFB sheet is coated on its front and back sides. The front is coated with developer and the back is coated with microcapsules. The manifold carbonless forms will usually comprise from about 2 to about 10 individual sheets and preferably from about 2 to about 4 individual sheets per form.

Generally speaking, two approaches have been taken to the manufacture of carbonless manifold forms. In one approach the forms paper is coated at a paper mill and shipped to the forms manufacturer who prints, perforates and collates the form. In the second approach, the CF and CB coating compositions are applied to the form by the forms manufacturer on the forms press. The latter methods are herein referred to as "on press" methods as contrasted with "off press" methods where the CF and CB coatings are applied at the paper mill.

A number of CF and CB coating compositions have been designed for application on the press.

U.S. Pat. No. 4,186,115 describes a CB coating comprising a color precursor and a liquid radiation curable composition which cures to a frangible resin.

U.S. Pat. No. 4,091,122 disclose CF and CB coating compositions containing a color developer or color precursor and a liquid radiation curable substance.

U.S. Pat. No. 4,143,890 discloses a hot melt CB coating composition prepared by dispersing an encapsulated color precursor into a wax based composition.

U.S. Pat. No. 4,097,619 and 4,112,138 describe on press processes using the aforementioned hot melt and radiation curable CF and CB coating compositions.

U.S. Pat. NO. 3,914,511 to Vassiliades discloses a process for spot printing aqueous-based CF and CB coating compositions using a printing roll having a raised resilient surface. According to the patent, the technique can be used to apply localized CB coating as well as CF coatings. The CF coatings are dispersions of acid clays, talc and other inorganic developers in water.

One of the drawbacks of prior on press aqueous CB and CF coating compositions is that they generally do not provide the image and/or typewriter intensity that off press coatings provide. One reason for this is that aqueous on press coating compositions are designed to set with little or no drying. This usually means that the coatings must be applied in lower coat weights than they are applied at the mill. As a consequence printing quality often suffers.

In conventional practice aqueous dispersions of developer resin have not been used "neat" as developer coatings either on or off the press. The developer resin constitutes less than 20%, and sometimes as little as 8%, of the aqueous coating composition. The developer resin is mixed with clay, silica, calcium carbonate, adhesives and other coating additives. In order to provide a sufficient quantity of developer material on the surface of the form to give high image density, high coat weights of these developer compositions are required. This too has relegated the use of the aqueous resin dispersion to mill operations where drying capacity is available to set these high coat weights as opposed to on the press where the drying capacity is limited.

SUMMARY OF THE INVENTION

The present invention is directed to a novel method for preparing a developer sheet wherein an aqueous dispersion of a phenolic resin is applied at high solids level to at least a portion of the front surface of a paper web. The resin dispersion is applied "neat", i.e., without the solid fillers conventionally used to enhance oil adsorption. This method can be performed on as well as off the press because a high amount of developer resin can be applied to the paper with little drying.

In accordance with the present invention, an aqueous dispersion of a phenolic developer resin containing about 30 to 60% solids and more preferably 40 to 55% solids is applied to paper or another substrate. The coating is applied at a coat weight of about 0.1 to 1 lbs/1300 sq. ft. and more preferably about 0.2 to 0.5 lbs/1300 sq. ft. In most cases, the coating can be dried on the press simply using a heated roller.

In accordance with a another embodiment of the invention, a portion of the water in the aqueous dispersion is replaced with a glycol or glycol ether such as polyethylene glycol or polypropylene glycol to further reduce the amount of heat required to dry the coating.

In accordance with still another embodiment of the invention, a developer sheet is provided wherein the developer sheet comprises a developer sheet comprising a substrate having a layer of a developer material on the surface thereof, said developer material being coated from an aqueous dispersion of a phenolic resin in water, said dispersion containing about 30 to 60% by weight of said resin and being essentially free of solid additives. The coating may contain a small amount (e.g., about 5%) of a material such as polyvinyl alcohol which functions as a dispersant and may assist in binding the resin to the substrate. These compositions are advantageous because they can be coated on or off the press with minimum drying and without solvent removal equipment and the precautions which accompany it. In addition, the coating exhibits good capillary action which enhances its reactivity with color precursors and sits upon the surface of the substrate in which it is coated so that it is readily accessible for reaction with the color precursor.

DETAILED DESCRIPTION OF THE INVENTION

Known phenolic developer resins may be used in the present invention.

A typical example of a useful phenolic resin is the condensation product of phenols (including substituted phenols) and formaldehyde. The resin may be further modified to include amounts of salicylic acids or substituted salicylic acids in a manner known in the art. Examples of phenolic resins are described in U.S. Pat. Nos.

3,455,721; 3,466,184; 3,672,935; 4,025,490; 4,226,962 and 4,612,254.

Another class of phenolic resin useful in the present invention is the products of oxidative coupling of substituted or unsubstituted phenols or biphenols. Oxidative coupling may be catalyzed by various catalysts but a particularly desirable catalyst is the enzyme, horseradish peroxidase. Particularly desirable developers are the resins described in commonly assigned U.S. Pat. No. 4,647,952 and more particularly the product of oxidative coupling of bisphenol A.

The phenolic developers used in the present invention may be metallated to improve their developing characteristics. They may be metallated by reaction with a salt selected from the group consisting of copper, zinc, aluminum, tin, cobalt and nickel salts. Most typically, the resins are zincated to improve development. The metal content of the resins generally is about 1 to 5% by weight but may range up to 15%.

Preferably developer materials such as phenolformaldehyde condensation products are used. More particularly, alkylphenolic resins and, still more particularly, metallated products of alkylphenolic resins are used. The alkyl phenols are monosubstituted by an alkyl group which may contain 1 to 12 carbon atoms. Examples of alkyl phenols are ortho- or para- substituted ethylphenol, propylphenol, butylphenol, amylphenol, hexylphenol, heptylphenol, octylphenol, nonylphenol, t-butylphenol, t-octylphenol, etc.

Another useful developer material is a resin-like condensation product of a polyvalent metal salt, such as a zinc salt, and a phenol, a phenol-formaldehyde condensation product, or a phenol-salicyclic acid-formaldehyde condensation product. This developer material is available from Schenectady Chemical Co. under the designation HRJ 4250 and HRJ 4252. These products are reported to be metallated condensation product of an ortho- or para- substituted alkylphenol, a substituted salicyclic acid, and formaldehyde.

Aqueous dispersions of the developer resin may be obtained by several processes. A developer material can be prepared in a conventional manner and a melt of the material can be atomized and dispersed in a solution of an emulsifying agent and water. Alternatively a melt of the developer material can be added to a rapidly agitated aqueous medium containing a dispersant. The developer material can also be dissolved in a solvent/non-solvent system and the solvent removed. Other materials such as Schenectady HRJ 2969, HRJ 4002, HRJ 4250, and HRJ 4252 resins are obtained in the form of an aqueous dispersion. The former two resins are zincated salicylated nonylphenols.

A particularly desirable dispersant for dispersing phenolic resins in water is polyvinyl alcohol. It is typically used in an amount of about 5% (dry weight) or about 0.2 to 1 part per 10 parts of the developer resin. It also helps adhere the resin particles to the developer sheet.

It may also be desirable to replace a portion of the water forming the aqueous resin dispersion with a glycol or glycol ether to further reduce drying requirements. Examples of useful glycols and glycol ethers are polyethylene glycol, polypropylene glycol, and ethylene glycol monomethyl or monoethyl ether. These materials may be added to the dispersion in amounts of about 5 to 30% solids.

Preferably the particle size of the dispersion ranges from about 0.1 to 4 microns and more typically 0.1 to 2 microns and averages about 1 micron.

The solids content of the dispersion and coat weight are controlled to minimize the need for drying. In addition, it has been found that the same considerations tend to hold the resin out on the surface of the paper where it is most accessible to the color former. Thus, higher image/typewriter intensities are achieved.

Aqueous dispersions of phenolic resins on the press can be used in conjunction with known methods of forms manufacture. In this regard, aqueous dispersions of phenolic resins can be used in the processes described in U.S. Pat. No. 4,097,619 to Davis et al. and U.S. Pat. No. 4,112,138 to Davis et al. The process of the present invention can be a process in which a plurality of continuous webs are advanced in a cooperating relationship, printed, coated with CF and CB compositions, collated, and finished.

The resin dispersions can be applied to any of the substrates commonly used in the manufacture of carbonless papers. Included in the preferred materials are paper and plastic films although other substrates can be substituted. The continuous webs can be supplied in any of a variety of shapes, sizes and configurations. The preferred and most common shape is a roll form.

The individual substrates are subjected to a printing or marking step prior to or after the coating step. Because the resin dispersions are somewhat opaque, they are preferably applied to the substrate prior to printing. For purposes of this application the term "printing" shall be understood to be generic to printing, writing, lining or any other marking of a continuous web whether the marking is visible or not. In the preferred process of this invention the topmost surface of each individual web of the plurality of continuous webs is printed with a printing ink to provide the printed information and blanks usually found in a business form. However, it is sometimes the case that only one surface, normally the topmost surface, of the topmost continuous web will be so marked. The actual content of the printing and the number of webs which are marked are dependent on the particular form being manufactured and may be conveniently adjusted during the manufacturing operation.

In the preferred embodiment of this invention the printing step is performed by the application of a marking fluid, preferably a printing ink, by a suitable printing apparatus to one or more surfaces of the continuous webs. The preferred printing method is offset although any of the other well known printing methods are equally applicable. The actual printing method depends on the printer capabilities of the particular manufacturer. The inks which can be used in this printing step are any of the inks commonly used in the printing industry. The ink must only be selected from a group or type which are compatible with the coating process and composition.

For the production of manifold carbonless forms according to the process of this invention it is necessary that at least one coating composition be applied to at least one surface of at least one web. In the preferred embodiment of this invention each web of the plurality of webs except the topmost web, will have a CF coating containing a color developer on the topmost surface and a CB coating containing an encapsulated color precursor on the bottommost surface with the exception of the bottommost web which will contain a CF coating but no CB coating.

A particular advantage of the process of this invention is that it permits the use of spot coating. Spot coating refers to the fact that less than 100% of the surface area of the individual sheet is coated.

For instance, the area of the paper normally associated with the margin on either side of the printed side portion need not be coated. This, of course, represents a significant cost advantage in the savings of material. The use of spot printing can vary from simply omitting coating of the margin portion of the paper to the making of a form wherein only a single line is actually coated. At the same time, forms such as computer printouts can be made wherein only every other line is coated. Thus it can be seen that from about 10% to about 95% of the surface area of the paper need not be coated. In most instances, it would be most convenient to simply not print the marginal areas of the paper which would save from about 10% to about 30% of the total material cost.

The present invention can be used in a discontinuous process wherein individual substrates are coated and printed and then collated or a continuous process wherein a plurality of continuous webs in spaced relation are marked, coated and collated.

Having described the invention in detail and by reference to the preferred embodiments thereof, numerous modifications and variations are possible without departing from the scope of the following claims.

What is claimed is:

1. A process for producing a developer sheet having one surface coated with a developer resin which comprises providing a web having a front and a back surface, and applying an aqueous dispersion of a phenolic developer resin to at least a portion of said front surface, said aqueous dispersion of said developer resin consisting essentially of about 30 to 60% by weight of said developer resin as solids, and water, said dispersion being applied neat at a coat weight of from about 0.1 to about 1 pounds dry weight per 1300 square feet.

2. The process of claim 1 wherein said aqueous dispersion contains about 40 to 55% by weight of said developer resin as solids, and said dispersion is applied at a coat weight of from about 0.2 to about 0.5 pounds dry weight per 1300 square feet.

3. The process of claim 2 wherein said process is performed on a forms press.

4. The process of claim 3 wherein said aqueous dispersion additionally contains a glycol ether or a glycol.

5. The process of claim 3 wherein said aqueous dispersion contains up to about 5% by weight polyvinyl alcohol.

6. A process for producing a manifold carbonless form having one surface coated with a developer resin comprising the steps of:

(a) providing a web having a front and a back surface,
(b) marking said front surface of said web, and
(c) applying an aqueous dispersion of a phenolic developer resin neat at a coat weight from about 0.1 to about 1 pounds dry weight per 1300 square feet to at least a portion of said front surface of said web, wherein said aqueous dispersion of said phenolic developer resin consists essentially of about 30 to 60% by weight of said developer resin as solids, a dispersant, and water wherein steps (b) and (c) may be reversed.

7. The process of claim 6 wherein said aqueous dispersion of said phenolic resin contains about 40 to 55% by weight of said phenolic resin as solids, and said dispersion is applied at a coat weight of from about 0.2 to about 0.5 pounds dry weight per 1300 square feet.

8. The process of claim 7 wherein said dispersion of said phenolic resin ranges in particle size from about 0.1 to 4.0 microns.

9. The process of claim 8 wherein said process further comprises coating said back surface with a coating composition containing a microencapsulated color precursor which is capable of reacting with said phenolic resin to produce a colored image.

10. The process of claim 7 wherein said aqueous dispersion additionally contains a glycol ether or a glycol.

11. The process of claim 7 wherein said aqueous dispersion contains up to about 5% by weight polyvinyl alcohol.

12. A process for the continuous production of a manifold carbonless form having two or more surfaces coated with chromogenic material comprising:

(a) providing a plurality of continuous webs, each of said webs having a front and a back surface;
(b) advancing each web of said plurality of continuous webs in a cooperating relationship with one another;
(c) applying a first coating of an aqueous dispersion of a phenolic resin neat at a coat weight of about 0.1 to about 1 pounds dry weight per 1300 square feet, said dispersion consisting essentially of about 30 to 60% by weight of said developer resin as solids, a dispersant, and water to at least a portion of said front surface of at least one web of said plurality of continuous webs;
(d) setting said first coating;
(e) printing at least one front surface of at least one web of said plurality of continuous webs with a pattern;
(f) applying a second coating of a microencapsulated color precursor to at least a portion of said back surface of at least one web of said plurality of continuous webs;
(g) setting said second coating; and
(h) collating said plurality of continuous webs.

13. The process of claim 12 wherein said dispersion of phenolic resin ranges in particle size from about 0.1 to 4.0 microns.

14. The process of claim 12 wherein said aqueous dispersion contains about 40 to 55% by weight of said developer resin as solids and said dispersion is applied at a coat weight of about 0.2 to about 0.5 pounds dry weight per 1300 square feet.

15. The process of claim 14 wherein said aqueous dispersion additionally contains a glycol ether or a glycol.

16. The process of claim 14 wherein said aqueous dispersion contains up to about 5% by weight polyvinyl alcohol.

17. A developer sheet comprising a substrate having a layer of a developer material on the surface thereof, said developer material being applied neat from an aqueous dispersion of a phenolic resin in water, said dispersion containing about 30 to 50% by weight of said phenolic resin as solids, said dispersion being applied at a coat weight from about 0.1 to 1 pounds dry weight per 1300 square feet.

18. The developer sheet of claim 11 wherein said aqueous dispersion contains about 40 to 55% by weight of said developer resin as solids, and said dispersion is applied at a coat weight of from about 0.2 to about 0.5 pounds dry weight per 1300 square feet.

19. The developer sheet of claim 18 wherein said aqueous dispersion additionally contains a glycol ether or a glycol.

20. The developer sheet of claim 18 wherein said aqueous dispersion contains up to about 5% by weight polyvinyl alcohol.

* * * * *

UNITED STATES PATENT AND TRADEMARK OFFICE

CERTIFICATE OF CORRECTION

PATENT NO. : 4,992,412
DATED : February 12, 1991
INVENTOR(S) : Robert A. Fedders It is certified that error appears in the above-indentified patent and that said Letters Patent is hereby corrected as shown below:

Column 6, line 62, "30 to 50%" should read --30 to 60%--.

Column 6, line 66, "claim 11" should read --claim 17--.

Signed and Sealed this

Twenty-seventh Day of September, 1994

*Attest:*

*Attesting Officer*

Bruce Lehman

BRUCE LEHMAN

*Commissioner of Patents and Trademarks*